US010103441B2

(12) United States Patent
Legare

(10) Patent No.: US 10,103,441 B2
(45) Date of Patent: Oct. 16, 2018

(54) MULTI-BAND ELECTRONICALLY STEERED ANTENNA

(71) Applicant: THE UNITED STATES OF AMERICA AS REPRESENTED BY THE SECRETARY OF THE AIR FORCE, Washington, DC (US)

(72) Inventor: David J. Legare, Ava, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 333 days.

(21) Appl. No.: 15/149,215

(22) Filed: May 9, 2016

(65) Prior Publication Data

US 2017/0062928 A1 Mar. 2, 2017

Related U.S. Application Data

(60) Provisional application No. 62/209,393, filed on Aug. 25, 2015.

(51) Int. Cl.

| | |
|---|---|
| ***H01Q 3/00*** | (2006.01) |
| ***H01Q 9/04*** | (2006.01) |
| ***H01Q 21/06*** | (2006.01) |
| ***H01Q 5/357*** | (2015.01) |
| *H01Q 3/26* | (2006.01) |
| *H01Q 3/30* | (2006.01) |
| *H01Q 25/00* | (2006.01) |
| *H01Q 5/30* | (2015.01) |

(52) U.S. Cl.
CPC ..... *H01Q 9/0442* (2013.01); *H01Q 5/357* (2015.01); *H01Q 9/0485* (2013.01); *H01Q 21/065* (2013.01); *H01Q 3/26* (2013.01); *H01Q 3/30* (2013.01); *H01Q 5/30* (2015.01); *H01Q 25/00* (2013.01)

(58) Field of Classification Search
CPC ..... H01Q 3/26; H01Q 3/30; H01Q 5/357; H01Q 5/30; H01Q 9/0442; H01Q 9/0485; H01Q 21/065; H01Q 25/00
USPC ..... 342/372, 374, 354
See application file for complete search history.

(56) References Cited

U.S. PATENT DOCUMENTS 6,198,438 B1 * 3/2001 Herd ..... H01Q 3/247 343/700 MS
7,880,685 B2 * 2/2011 Norvell ..... H01Q 21/0075 343/700 MS (Continued)

*Primary Examiner* — Chuong P Nguyen
(74) *Attorney, Agent, or Firm* — Joseph A. Mancini

(57) ABSTRACT

Antenna system being tunable over multiple frequency bands. One planar surface of the antenna structure has metallic radiating elements of various geometries with selectable electrical interconnections between the radiating elements. An opposite side of the antenna structure has a signal transmission network with signal feedthroughs to selected metallic radiating elements. The signal transmission network also has phase shift inducing means. Depending on the frequency band of operation, metallic radiating elements are appropriately combined through the electrical interconnections to form composite radiating elements with resonant frequencies within the frequency band of operation. Induced phase shifts in the signal paths feeding selected metallic radiating elements cause a net resultant free-space directivity gain.

9 Claims, 6 Drawing Sheets

(56) References Cited

U.S. PATENT DOCUMENTS

| | | | | |
|---|---|---|---|---|
| 8,605,004 | B2 * | 12/2013 | Legare | H01Q 3/24 343/810 |
| 8,654,034 | B2 * | 2/2014 | Legare | H01Q 21/061 343/745 |
| 8,842,054 | B2 * | 9/2014 | Zhang | H01Q 21/24 235/487 |
| 9,692,124 | B2 * | 6/2017 | Caimi | H01Q 5/22 |
| 2005/0179614 | A1 * | 8/2005 | Nagy | H01Q 3/24 343/909 |
| 2008/0048917 | A1 * | 2/2008 | Achour | H01Q 1/38 343/700 MS |
| 2014/0184455 | A1 * | 7/2014 | Lea | H01Q 9/285 343/745 |
| 2015/0119052 | A1 * | 4/2015 | Caimi | H01Q 5/22 455/450 |
| 2015/0214615 | A1 * | 7/2015 | Patel | H01Q 3/36 342/372 |

* cited by examiner

20 GHz

MULTI-BAND ELECTRONICALLY STEERED ANTENNA

PRIORITY CLAIM UNDER 35 U.S.C. § 119(e)

This patent application claims the priority benefit of the filing date of provisional application Ser. No. 62/209,393 having been filed in the United States Patent and Trademark Office on Aug. 25, 2015 and now incorporated by reference herein.

STATEMENT OF GOVERNMENT INTEREST

The invention described herein may be manufactured and used by or for the Government for governmental purposes without the payment of any royalty thereon.

BACKGROUND OF THE INVENTION

Technical Field of the Invention

This invention relates generally to the field of communications antennas. More specifically the present invention relates to a design concept for a reconfigurable planar antenna, in which two or more frequency bands can be singularly and selectively supported at any given time.

The development of antennas for use on moving platforms such as aircraft and ground vehicles has not been particularly difficult for low frequency applications where near-omnidirectional antenna beam patterns provide sufficient radio frequency (RF) gain. However, at higher frequencies an air or ground vehicle antenna must possess a degree of spatial directionality to achieve sufficient gain to close transmit and receive communications links.

Spatially-directional antennas used in air and ground vehicle applications must also have beam steering capabilities in order to maintain line-of-sight communications. Where the dynamics are not too great, beam steering on moving platforms has been accomplished by mechanically steering means. However, when dynamics are high, electronic beam phase-shift steering is the only means that will suffice.

When airborne antenna applications will have an adverse impact on aerodynamics planar, electronically phase-shift steered antennas represent the only viable solution because they afford integration into the airframe with minimal disturbance to airflow. Conformal antennas provide the ultimate solution to integration into an airframe because conformal arrays can be shaped to match portions of an aircraft such as wing leading edges. The application of multiple conformal arrays also relaxes the requirements for phase steering because at any given time the conformal array pointed being oriented nearest to boresight can be selected to carry the communications link.

Moreover, because antennas are generally designed to operate at a given relatively narrow frequency band, by design, their operational frequency range is generally fixed. Wide bandwidth antennas solve the problem of having to integrate a separate system of antenna arrays into an aircraft for each frequency band of interest. To the extent that a single antenna array can be reconfigured in real time to support multiple frequency bands of operation, the better in terms of power, weight, and space.

A number of prior methods propose reconfigurable planar designs employing arrays of identical small elements (with dimensions less than 1/10 wavelength of the highest frequency supported). Although providing the best solution in theory, these are difficult to implement due to complexity and lack of RF switching components and materials which possess the physical and electrical properties (small enough size, low enough insertion loss) required for practical implementation. The fact that these techniques have only been so far implemented in a limited, laboratory environment bears this out.

What is needed therefore is a communications antenna system and structure that provides real time control over electronic beam steering and operational frequency band, while possessing a simple planar structure with adaptability to conformal integration with a host platform.

OBJECTS AND SUMMARY OF THE INVENTION

It is therefore a primary object of this invention to provide for a reconfrgurable planar antenna that can selectively operate at two or more fixed frequencies, and which can be readily implemented and operationally deployed today using existing and proven state-of-the-art technology.

A particular object of the invention is the selective formation of one or more specific radiating patch antenna geometries via RF switch connection of a pattern of smaller antenna metallic patch segments on the front (radiating) surface of the planar antenna. Note here that the highest frequency mode could preferably be formed by a single patch (or a series of patches to form a full antenna array) which is resonant at this highest frequency. Successive lower frequency configurations would then be formed around this core patch (or array of patches) by electrical concatenation of surrounding patch segments via RF switch connections. The antenna can further incorporate electronic beam steering via phase shifting or true time delay applied within the signal feed to each radiating patch element in the array for any of the available antenna frequency configurations selected.

A further object of the invention will be to provide for an antenna in which this frequency selectability is easily software controlled by the user, and which can be made to occur repeatedly with a very fast cycle time (on the order of a few milliseconds or less).

An additional object of the invention will be to provide for an antenna which is very thin and light-weight, and which can be made conformal to the platform on which it is mounted. This includes the possibility of a wearable antenna by a person.

A final, but vital object of the invention for mobile applications is the electronic steerability of the antenna, while still maintaining all of the above aspects of its design.

Other objects and various implementations made possible by this design approach will become apparent in the detailed description of the invention to follow.

In a preferred embodiment of the present invention, an antenna structure, comprises a first surface and an opposing second surface having a substrate disposed therebetween; a plurality of metallic radiating elements having various geometries and surface areas being disposed on the first surface; a first plurality of switches selectably interconnecting the plurality of metallic radiating elements; a radio frequency transmission network having a plurality of transmission paths being selectably interconnected to a radio frequency signal source by a second plurality of switches, all being disposed on the second surface; and fixed transmission paths through the substrate being disposed between the predetermined metallic radiating elements and the transmission paths; wherein selectable actuation among the second plurality of switches causes a connection of the radio frequency signal source to the selected predetermined metallic radiating elements; and wherein selectable actuation among the first plurality of switches causes a resultant net metallic radiating element surface area having a predetermined resonant frequency.

In another embodiment of the present invention having the aforesaid structure, a method for providing directed aperture gain over multiple frequency bands, comprises the steps of selectably connecting said signal paths to predetermined said metallic radiating elements; selectably interconnecting the metallic radiating elements so as to cause the interconnected metallic radiating elements to resonate within a desired frequency band; and imparting a phase shift within the signal paths so as to cause the combined effect of the resonant metallic radiating elements to be directed aperture gain.

Briefly stated, the invention provides an antenna system being tunable over multiple frequency bands. One planar surface of the antenna structure has metallic radiating elements of various geometries with selectable electrical interconnections between the radiating elements. An opposite side of the antenna structure has a signal transmission network with signal feedthroughs to selected metallic radiating elements. The signal transmission network also has phase shift inducing means. Depending on the frequency band of operation, metallic radiating elements are appropriately combined through the electrical interconnections to form composite radiating elements with resonant frequencies within the frequency band of operation. Induced phase shifts in the signal paths feeding selected metallic radiating elements cause a net resultant free-space directivity gain.

DETAILED DESCRIPTION OF THE PREFERRED EMBODIMENT

Although a great number of communications applications could be satisfied by a reconfigurable antenna that could operate over a continuous range of frequencies, for most practical applications, a limited number of set frequencies would be more than adequate. For example, virtually all satellite communications are limited to about 5 satellite bands (L, S, C, X, Ku and Ka band). Most single user requirements would cover only two or three of these; i.e. The lower (L, S, and C bands), and the higher (X, Ku, and Ka bands). Although a number of other RF bands are employed for non-satellite links, most user requirements could still be satisfied with a reconfigurable antenna that only operated at a relatively small number of fixed selectable frequencies.

Figure 1:
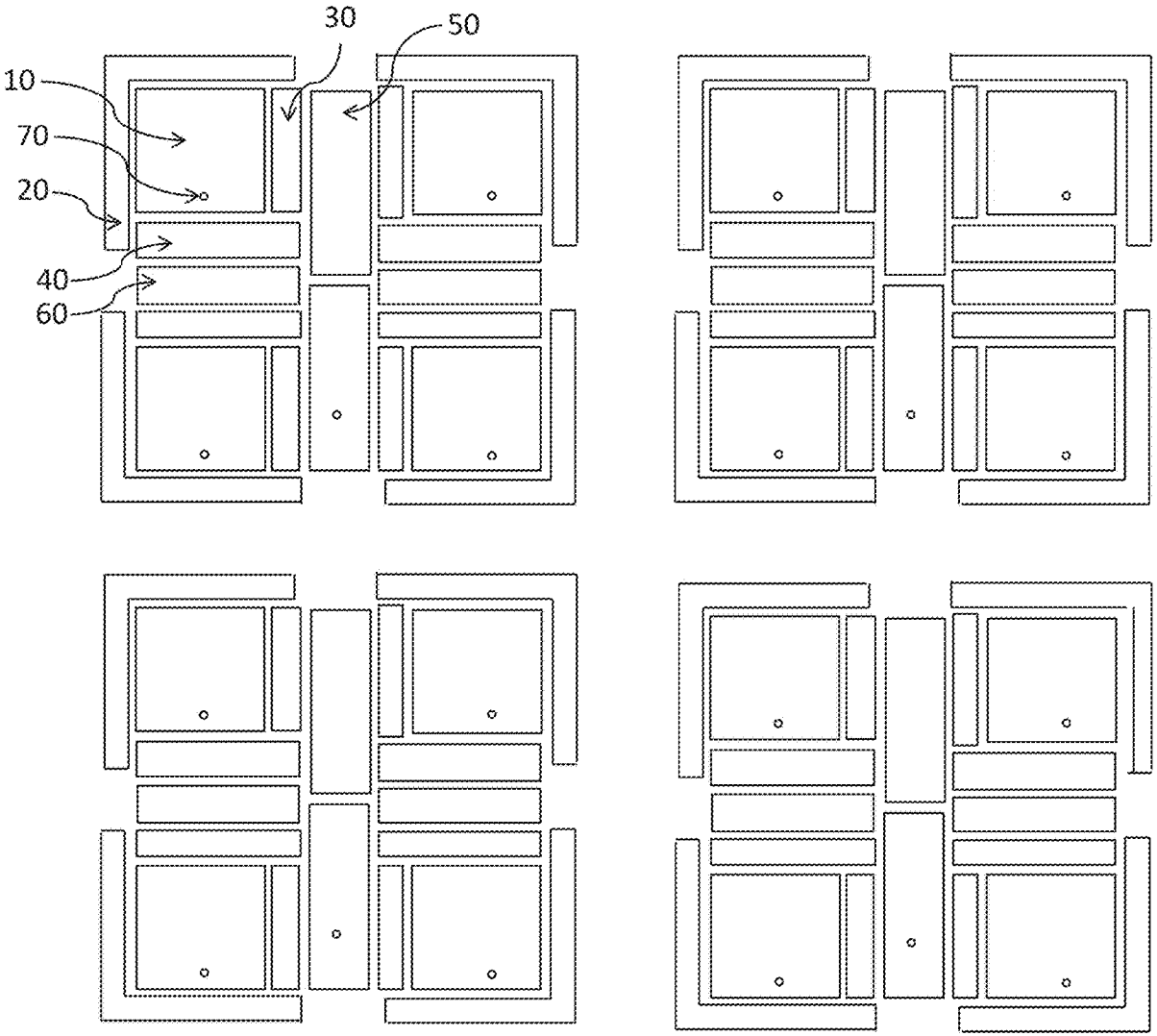
FIG. 1 depicts an exemplary topside view of the present invention's structure having electrically reconfigurably combinable radiating elements.

Referring to FIG. 1, it can be seen that an array of properly shaped and spaced metallic sub-patches 10, 20, 30, 40, 50, 60 (of possibly different shapes and sizes) can be electrically interconnected via very small RF switches (see FIG. 5), such as but not limited to RF MEMs switches, connected in different arrangements to form an array of larger radiating patch antennas which can radiate at their respective resonant frequencies.

Figure 2:
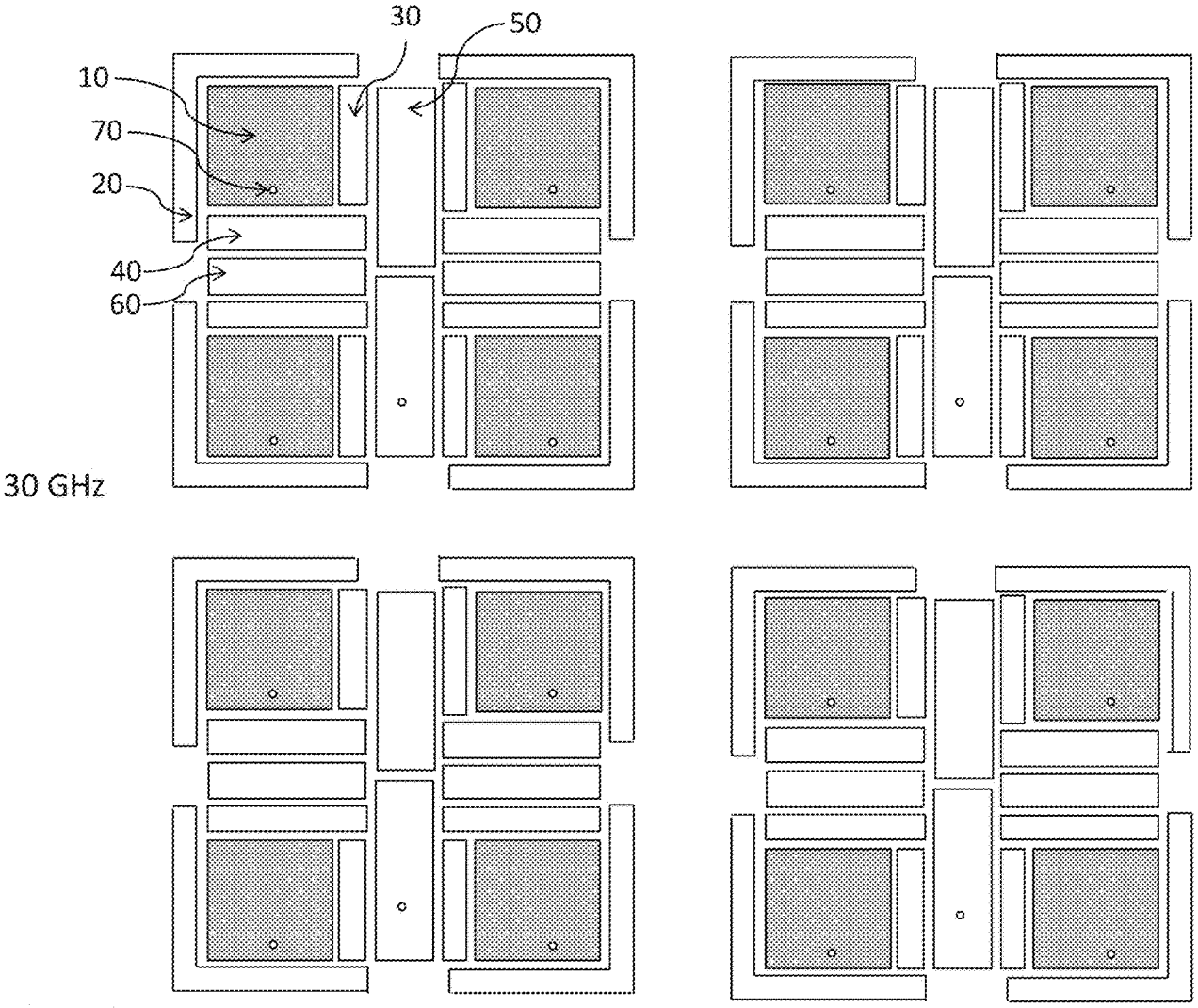
FIG. 2 depicts an exemplary topside view of the present invention's structure having electrically reconfigurably combinable radiating elements where sixteen high frequency radiating elements have been electrically formed.

Referring to FIG. 2, note that in a first configuration for high frequency bands, the shaded square patches 10 (core patches) by themselves form a sixteen element array antenna operating at a high end of the intended band range, for example, 30 GHz.

Figure 3:
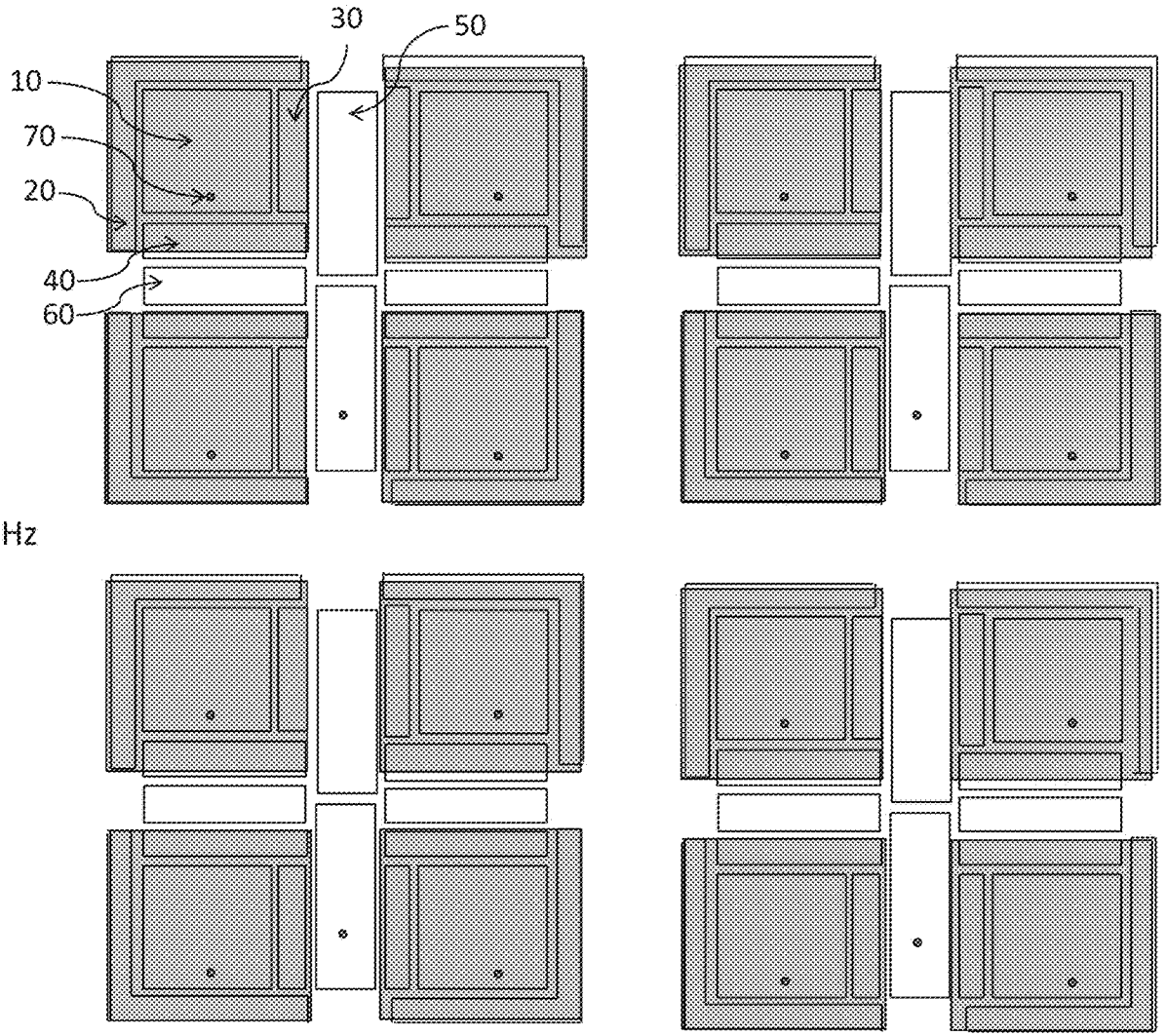
FIG. 3 depicts an exemplary topside view of the present invention's structure having electrically reconfigurably combinable radiating elements where sixteen medium frequency radiating elements have been electrically formed.

Referring to FIG. 3, when the correct adjacent patch segments 20, 30, 40 are electrically interconnected to the center or core patch 10, an antenna array is now formed that radiates at a medium frequency range, for example, 20 GHz. Also note that in each of the respective frequency range configurations: high frequency range i.e., 30 GHz (see FIG. 2) medium frequency range i.e., 20 GHz (see FIG. 3) and low frequency range, i.e., 8 GHz (see FIG. 4), each has at least one antenna, patch segment with an RF feed point 70 about ⅓ of the way from its edge (for proper impedance matching). Note that the antenna segments are properly sized to maintain this geometry at both wavelengths. This RF feed point 70 is formed and signal-fed using vias through the underlying dielectric (middle layer) and backplane ground plane layer (see FIG. 6) which connect to an RF feed network 90 (see FIG. 6) which exists in a parallel plane on the opposing side of the antenna ground plane. This RF feed network 90 (see FIG. 6) could comprise (but not be limited to) a traditional strip line signal feed network design, and could preferably contain true time delay or phase shifting elements in line with and inserted into the signal feed to each radiating patch to allow for electronic beam steering in addition to frequency band selection. Thus, this design would provide for a very low profile, multiband electronically scanned antenna (ESA).

One limitation of a shared RF feed point 70 however, is the requirement for lamda/2 spacing between the composite antenna radiating patch elements (shaded structures in FIG. 1 through FIG. 5) and the radiating sub-patches 10, 20, 30, 40, 50, 60 to avoid grating lobes. Fortunately, this requirement can be maintained over a fairly large frequency range, so that RF feed points 70, and the phase shifting elements (see FIG. 6) can be shared by both bands. It is, however, understood that because a given time delay shift results in a different change in beam steering angle for each frequency, a phase shifter must have enough resolution (number of delay lines/states) to meet the beam steering resolution requirements of each band.

Figure 4:
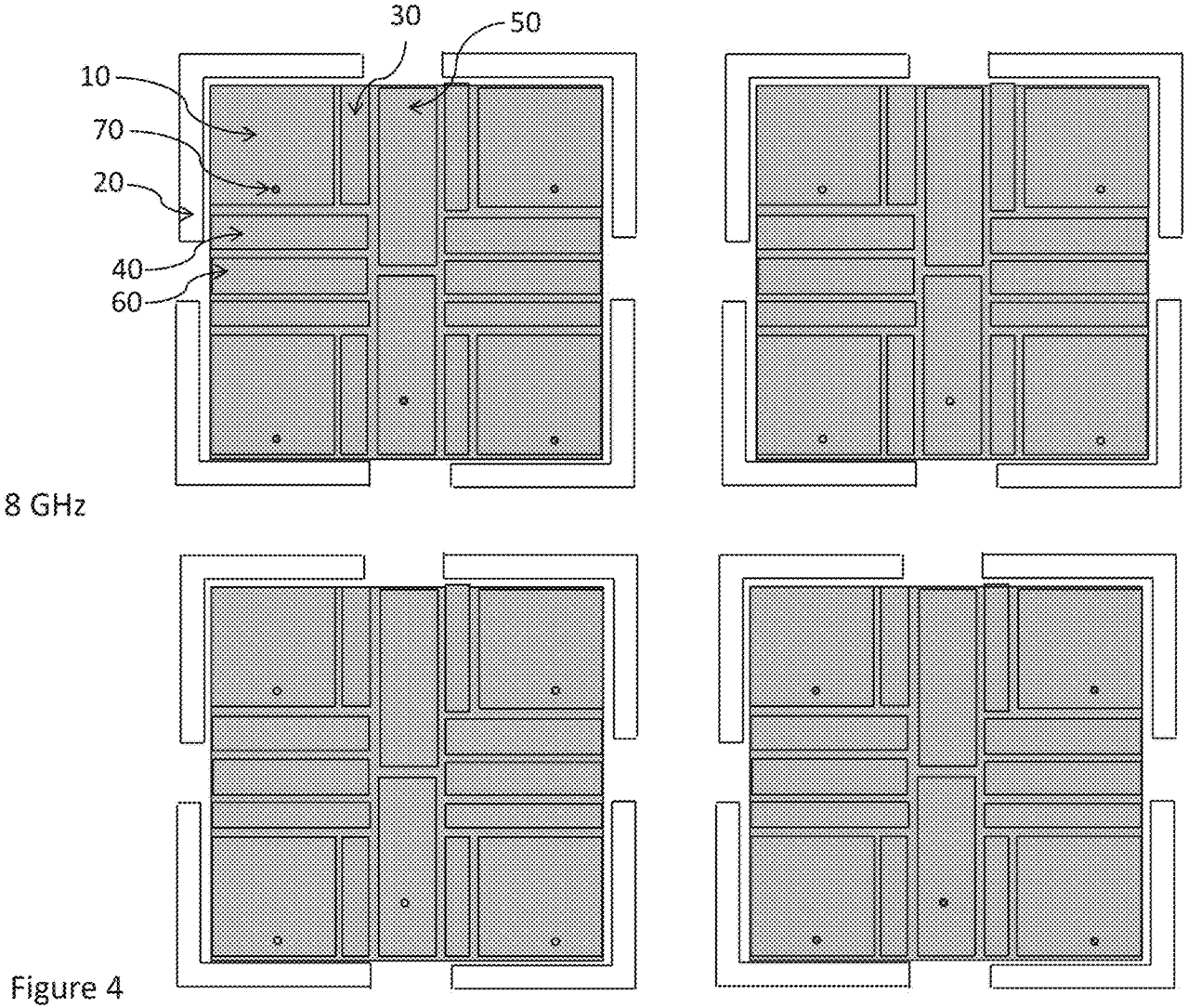
FIG. 4 depicts an exemplary topside view of the present invention's structure having electrically reconfigurably combinable radiating elements where four low frequency radiating elements have been electrically formed.

Referring to FIG. 4, it can be seen that a third or low frequency band (i.e., X-band, 7-9 GHz) is provided by another combination of radiating element patches 10, 30,40, 50, 60. It is clear that this antenna configuration can only fit a 2×2 patch element array in the same available surface area (instead of the previous 4×4's) due to the much larger X-band wavelength. It is also evident that a separate RF feed network (see FIG. 5) and feed point 70 vias are needed.

However, these could be accommodated on the same plane as the prior feed network, or a separate parallel backplane if required.

Figure 5:
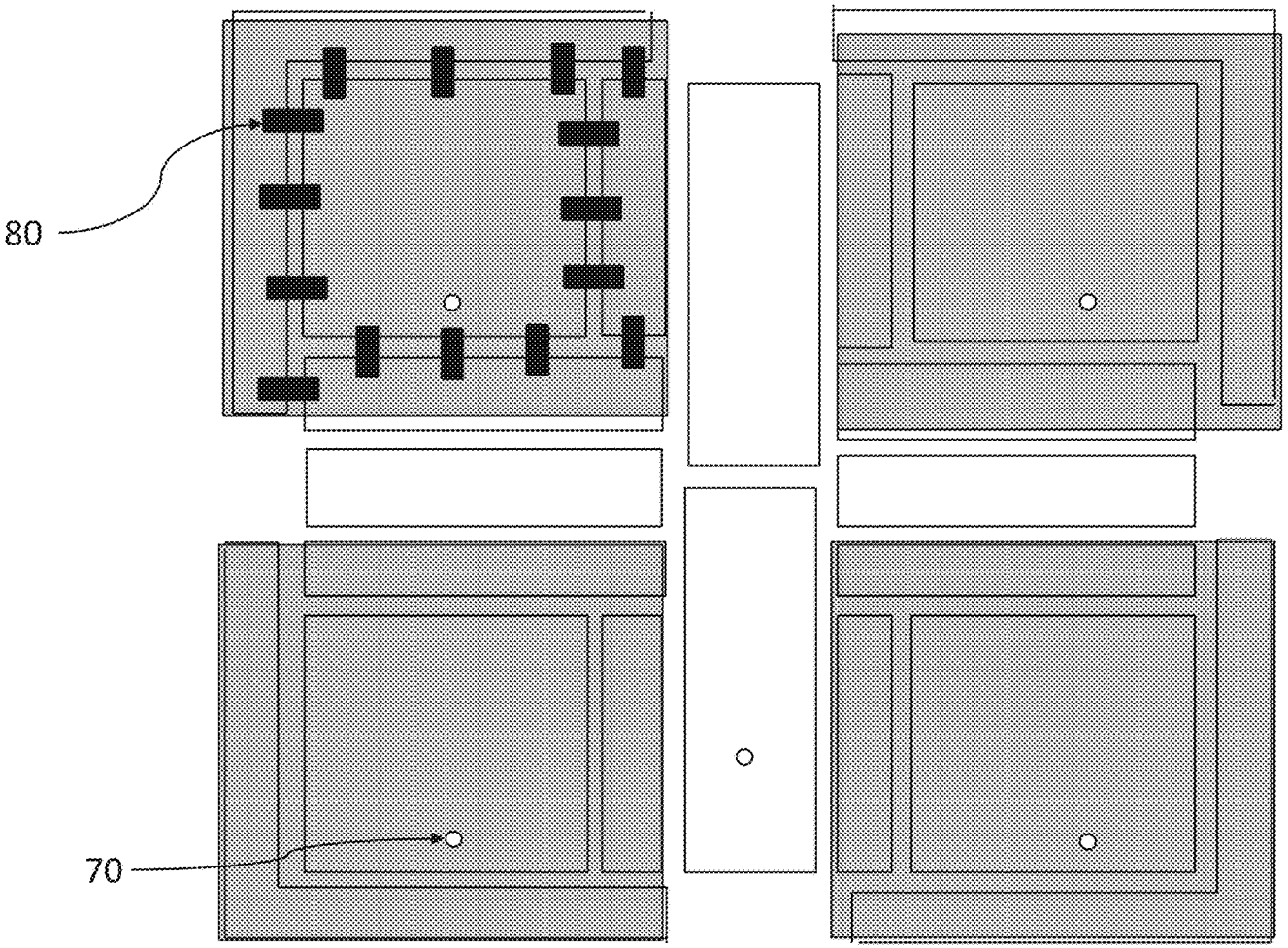
FIG. 5 depicts an exemplary topside view of one quadrant of the present invention configured for 20 GHz operation with particular illustration of the reconfrgurable radio frequency switch interconnections between antenna patch radiating elements.

Referring to FIG. 5 depicts the reconfigurable feature of the antenna. Depending upon the frequency band of operation desired, RF switches 80 may connect or disconnect adjacent antenna, radiating patch elements 10, 20, 30, 40, 50, 60 (see FIGS. 1, 2, 3, or 4) to achieve a composite antenna patch size which is resonant at the desired frequency band. FIG. 5 illustrates the desired RF switch interconnections (which may be MEMs devices) necessary to form a composite antenna patch size resonant at 20 GHZ, which corresponds to FIG. 3.

Figure 6:
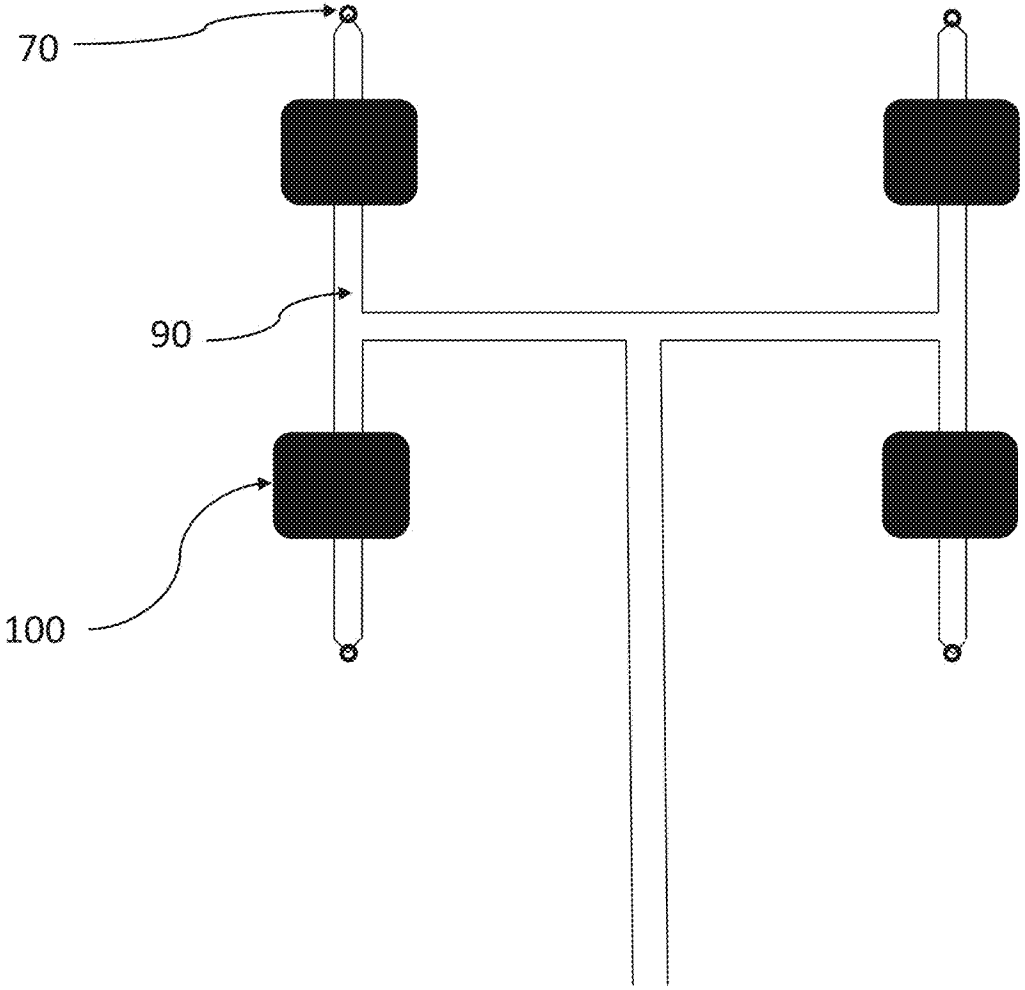
FIG. 6 depicts an exemplary bottom side view of the present invention with particular illustration of the radio frequency feed network and phase shifting elements.

Referring to FIG. 6 depicts the back side or back plane of the antenna of the present invention. In particular it illustrates the insertion of phase shifters 100 (which may be MEMs devices) in the RF feed network 90. By introducing a phase shift across each composite antenna patch (i.e., via computer processor and computer software instructions), the resultant antenna beam pattern may be steered off boresight.

The preferred approach to selecting and configuring among the radiating patch elements 10, 20, 30, 40, 50, 60 would be to hardwire the activating signal (a dc voltage applied to open or close an RF switch 80) to each interconnection RF switch using a series of traces on the backplane (see FIG. 6) of the antenna array. Thus, a pattern of traces would be established to each set of RF switches corresponding to each of a plurality of antenna radiating element configurations, each configuration corresponding to a desired frequency range of coverage. The user then (i.e., via computer processor and computer software instructions) chooses which one of the plurality RF switch sets to activate to establish that particular configuration.

Note that, although a number of micro-electronic RF switching devices are available at the present time, among the practical devices for this application are RF MEMs switches. This MEMs applicability holds true for both the antenna band switching function, and the true time delay phase shifting function required to provide electronic beam steering. This is because of the number of series connections involved, and the very low insertion loss of MEMs switches compared to the other legacy technologies (FETs and PN diodes).

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An antenna structure, comprising a first surface and an opposing second surface having a substrate disposed therebetween;

a plurality of metallic radiating elements having various geometries and surface areas being disposed on said first surface;

switches selectably interconnecting said plurality of metallic radiating elements;

a radio frequency transmission network having a plurality of transmission paths being selectably interconnected to a radio frequency signal source by switches, all disposed on said second surface; and fixed transmission paths through said substrate being disposed between predetermined said metallic radiating elements and said transmission paths; wherein selectable actuation among said switches causes a connection of said radio frequency signal source to selected said predetermined metallic radiating elements; and wherein selectable actuation among said switches causes a resultant net metallic radiating element surface area having a predetermined resonant frequency.

2. The antenna structure of claim 1, wherein said resonant frequency is within the band of said radio frequency signal.

3. The antenna structure of claim 1, wherein said first surface, said second surface and said substrate are arranged substantially parallel to each other.

4. The antenna structure of claim 1, wherein said substrate is a dielectric material.

5. The antenna structure of claim 1, wherein said switches are computer controlled.

6. The antenna structure of claim 1, wherein said radio frequency transmission network further comprises means for causing a relative phase difference between said transmission paths.

7. The antenna structure of claim 6, wherein said means for causing a relative phase difference is computer controlled.

8. The antenna structure of claim 6, wherein said means for causing a relative phase difference are microelectromechanical systems (MEMs).

9. The antenna structure of claim 1, wherein said switches are microelectromechanical systems (MEMs).

* * * * *